US006827143B2

(12) United States Patent
McGuffin et al.

(10) Patent No.: US 6,827,143 B2
(45) Date of Patent: Dec. 7, 2004

(54) CASING CENTERING TOOL ASSEMBLY

(76) Inventors: Martin H. McGuffin, 2120A Potomac, Houston, TX (US) 77057; Webster W. Spencer, Jr., 246 Plantation, Houston, TX (US) 77024

( * ) Notice: Subject to any disclaimer, the term of this patent is extended or adjusted under 35 U.S.C. 154(b) by 165 days.

(21) Appl. No.: 10/351,668

(22) Filed: Jan. 27, 2003

(65) Prior Publication Data

US 2003/0226248 A1 Dec. 11, 2003

Related U.S. Application Data

(60) Provisional application No. 60/387,210, filed on Jun. 7, 2002.

(51) Int. Cl.[7] ..... E21B 19/20

(52) U.S. Cl. ..... 166/77.51; 166/85.5; 166/380; 175/52

(58) Field of Search ..... 166/77.51, 77.55, 166/85.1, 85.5, 341, 342, 378, 380; 175/52, 79, 162, 256

(56) References Cited

U.S. PATENT DOCUMENTS

| | | | | |
|---|---|---|---|---|
| 3,556,042 A | | 1/1971 | Laughlin et al. | |
| 4,223,920 A | * | 9/1980 | Van Bilderbeek | 285/24 |
| 4,585,061 A | * | 4/1986 | Lyons et al. | 166/77.3 |
| 4,765,401 A | * | 8/1988 | Boyadjieff | 166/77.53 |
| 5,848,647 A | | 12/1998 | Webre et al. | |
| 6,062,312 A | * | 5/2000 | Wilkins | 166/340 |
| 6,089,338 A | | 7/2000 | Bouligny, Jr. | |
| 6,138,776 A | | 10/2000 | Hart et al. | |
| 6,227,587 B1 | | 5/2001 | Terral | |
| 6,264,395 B1 | | 7/2001 | Allamon et al. | |
| 6,270,136 B1 | | 8/2001 | Dagenais | |
| 6,330,911 B1 | | 12/2001 | Allen et al. | |
| 6,471,439 B2 | | 10/2002 | Allamon et al. | |

OTHER PUBLICATIONS

"Photograph of Slips," www.glossary.oilfield.slb.com, printed from Internet Apr. 28, 2003, 1 page, photo courtesy of the Petroleum Extension Service, The University of Texas at Austin. Date of publication unknown.

"CMS–XL Extra Long Multi–Segment Casing Clips," www.cam–tech.com, printed from internet Apr. 28, 2003, 1 page. Date of publication unknown.

"Casing Slips," www.rutong.com.cn, printed from internet Apr. 28, 2003, 1 page, © 2002 Jiangsu Rudong General Machinery Co., Ltd. Date of publication unknown.

"Casing Slips—Reconditioned," www.jtoilfield.com, printed from internet Apr. 28, 2003, 3 pages. Date of publication unknown.

* cited by examiner

*Primary Examiner*—Frank Tsay
(74) *Attorney, Agent, or Firm*—Douglas W. Rommelmann; Andrews Kurth LLP

(57) ABSTRACT

A centering tool assembly helps centrally position a casing in a tubing using a baseplate, actuator, support tube, power source, and reaction studs. The baseplate is positioned on an outside edge of the tubing. The actuator is either preinstalled on the baseplate or installed after positioning on the tubing's outside edge. The support tube vertically adjusts the actuator. The power source activates the actuator which provides a force against the casing, moving the casing into the central position. Reaction studs or counteracting members help stabilize the centering tool assembly during this positioning. The centering tool assembly may be used to either pull or push the casing into the desired position. Additionally, a method for centering a casing into a central or desired position in a tubing involves placing a baseplate on the edge of the casing. An actuator is installed on the baseplate and vertically adjusted via a support tube. The actuator is actuated via a power source, providing a force against the casing and moving the casing into the desired position.

33 Claims, 9 Drawing Sheets

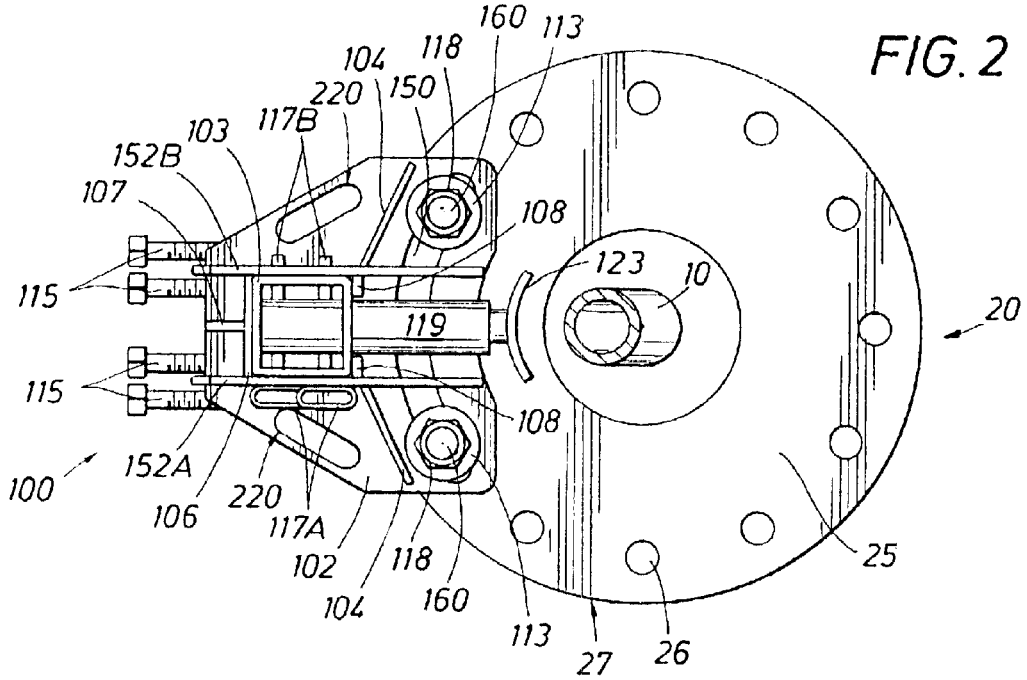
FIG. 2
FIG. 1
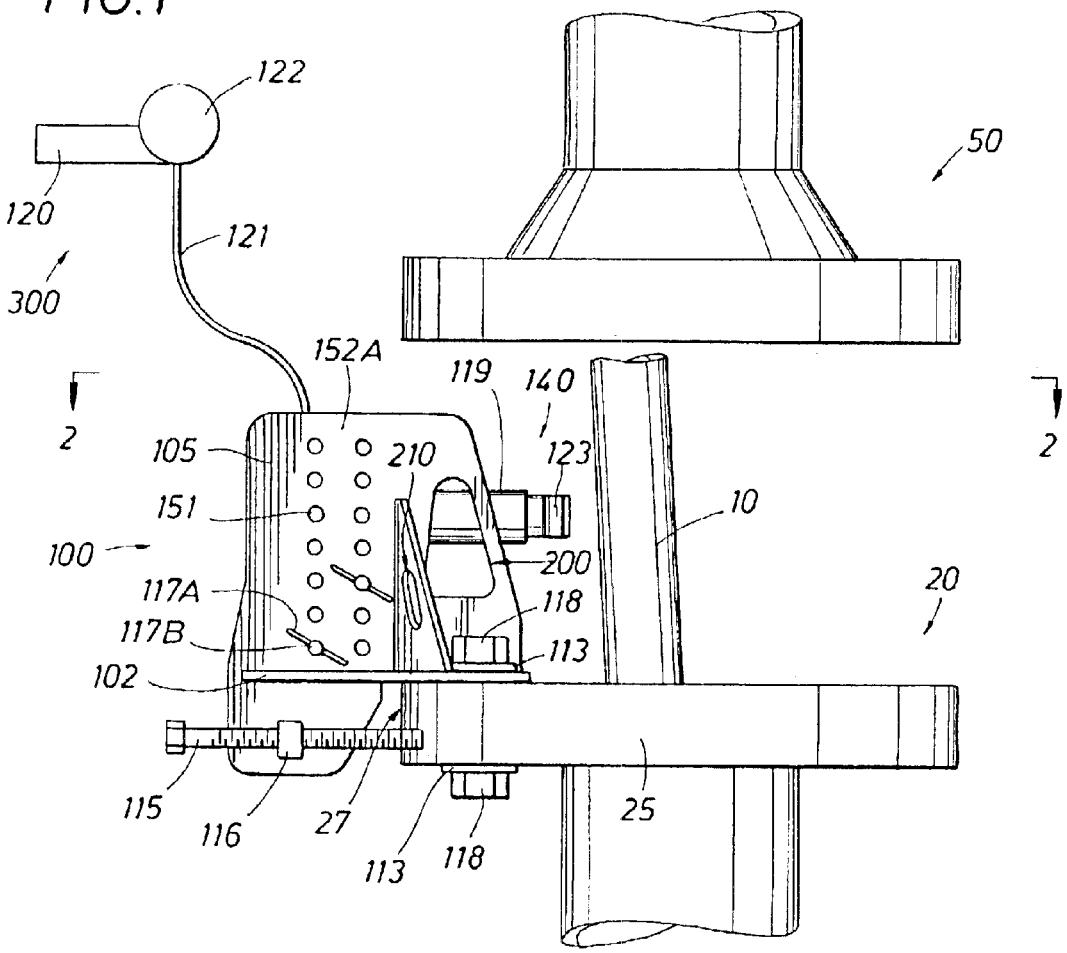

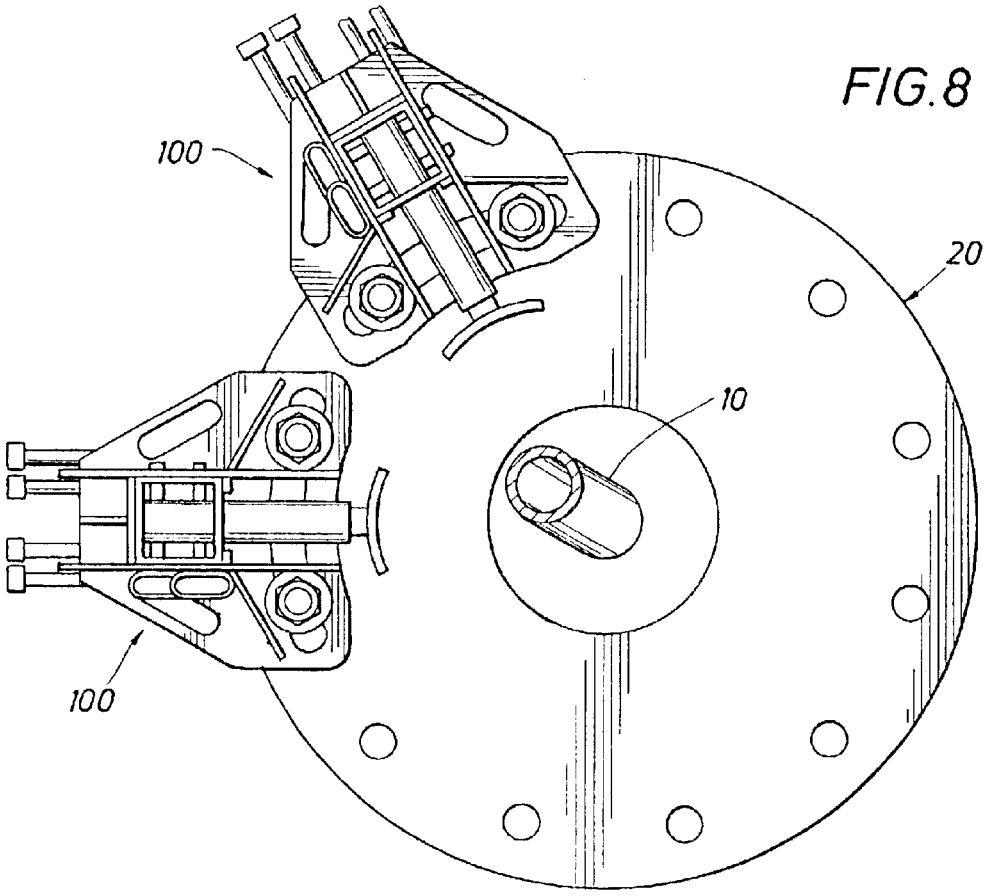
FIG. 8
FIG. 7
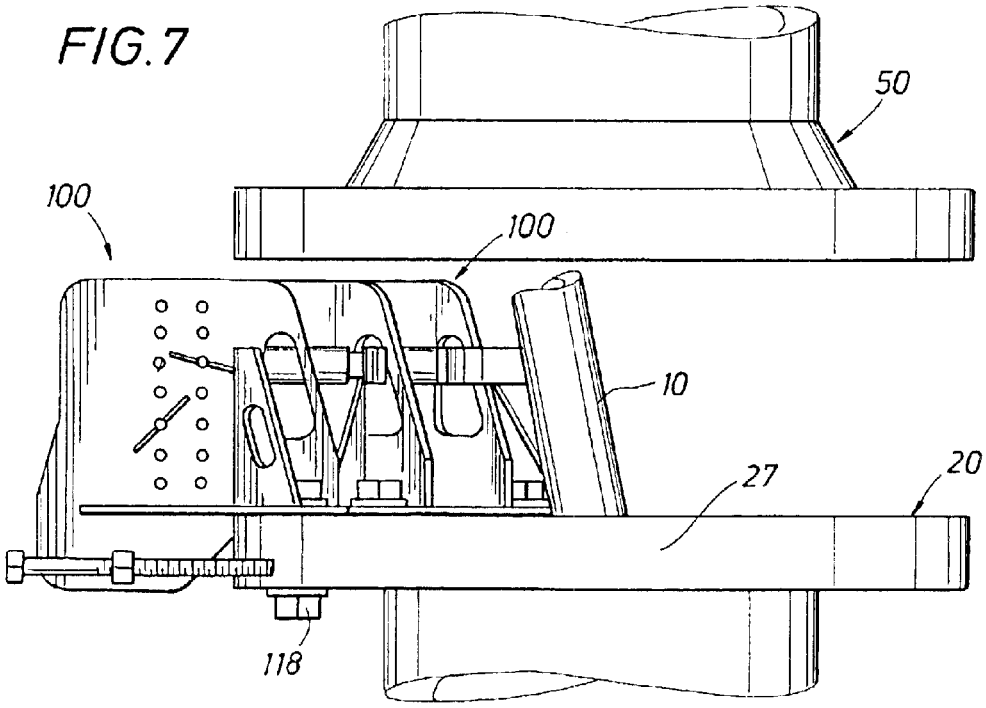

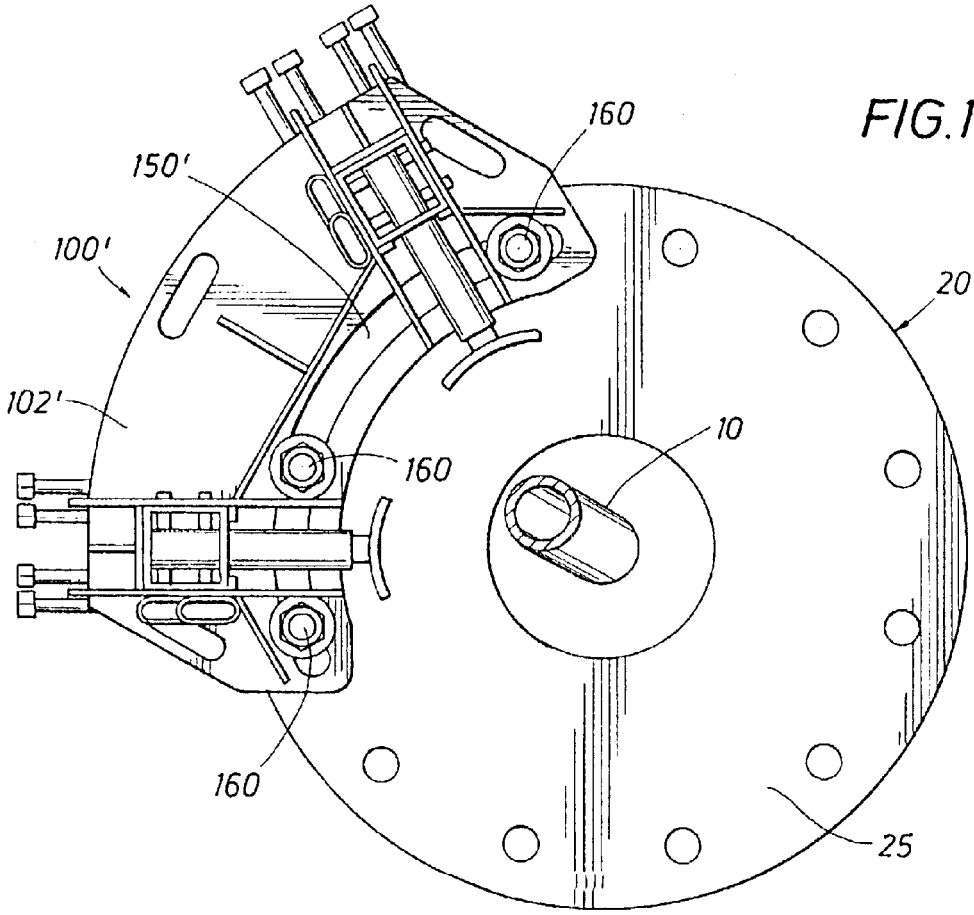
FIG. 10
FIG. 9
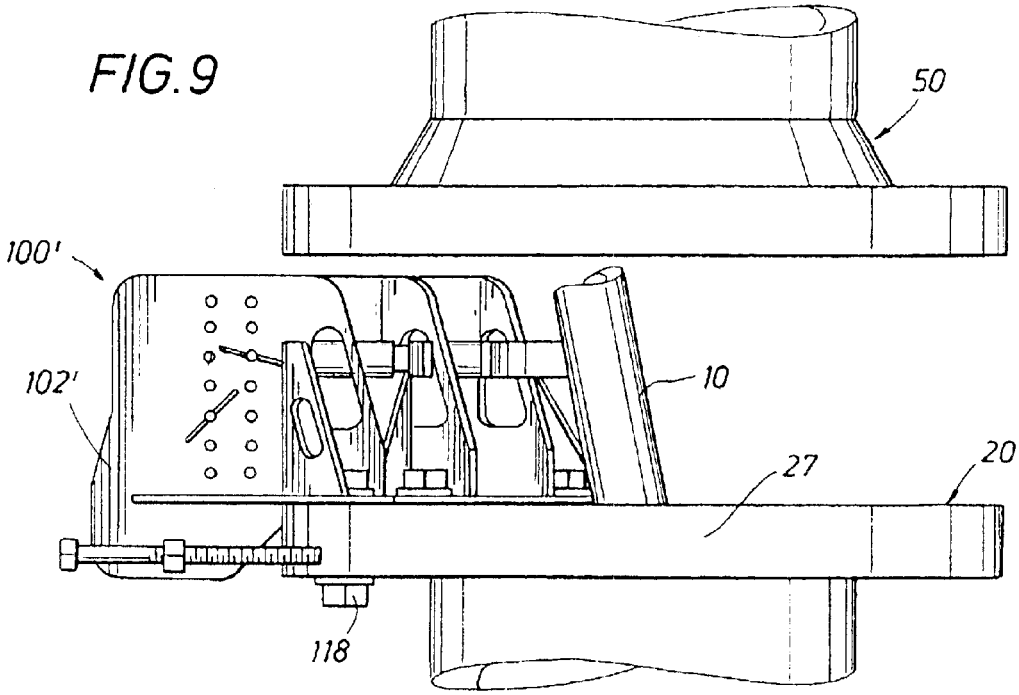

CASING CENTERING TOOL ASSEMBLY

CROSS-REFERENCE TO RELATED APPLICATIONS

This application claims priority to co-pending U.S. provisional application Ser. No. 60/387,210 filed on Jun. 7, 2002, which is hereby incorporated by reference in its entirety for all purposes.

STATEMENTS REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The invention is generally related to devices which facilitate operations in fluid and hydrocarbon production; and, more particularly, the invention relates to devices which aid in the positioning of one piece of casing or tubing with respect to another.

2. Description of the Related Art

For onshore and offshore fluid production operations (for example, hydrocarbon production), at times it is necessary to install a smaller diameter casing within larger diameter tubing, such as a conductor pipe, a well head, another casing or the like. To facilitate the placement of the smaller diameter casing in the larger diameter tubing, wedge-like slips are well known in the art. However, at times, the smaller diameter casing lies in a non-central location within the outer pipe. In order to install the slips, the casing must be centrally aligned.

In drilling operations, past and present, certain basic procedures apply. A drilling rig, onshore or offshore, bores a hole in the ground to a specified objective depth where natural resources are projected to exist. This drilling is not always accomplished by simply drilling a single hole with a single diameter, but rather can be a string of holes (for example, two or more) with varying diameters.

In the commencement of a well, a large diameter pipe known as a conductor pipe is driven into the ground or ocean floor to a depth of anywhere from one to three-hundred feet or more under the surface (ground/ocean floor level). After the conductor pipe is driven, a large diameter hole—known as a surface hole—is drilled through the conductor pipe to a pre-specified depth (typical depths being up to 2,000 feet or more under the surface). Next, a string of pipe called "surface casing" is run through the conductor pipe and surface hole, from the surface to the bottom of the surface hole. This string of pipe is cemented into the earth's crust, and then cut off at the surface above the conductor pipe. Next, a surface wellhead assembly, called the "A" section, is placed at the surface on top of the surface casing, whereupon the "A" section is secured to the surface casing by welding or other special techniques.

After the securing of the "A" section, a blowout preventer is affixed to the top of the "A" section. The blowout preventer, after being secured, is tested. If the blowout preventer functions, drilling activity commences.

In the commencement of drilling activity, a smaller hole is drilled through the larger surface casing to a deeper specified depth. Then, smaller diameter casing is run from the surface to a specified depth and again cemented into the earth's crust. Next, the string of casing is suspended on the "A" section and surface casing to avoid collapse. To accomplish this, the blowout preventer is uncoupled and lifted to allow working clearance above the "A" section. A set of casing slips are placed around the subject smaller diameter casing and lowered into the "A" section top. The "A" section top has a special low tolerance bowl for receiving the casing slips at its top section. In order to place these slips into the bowl of the "A" section receptacle, the smaller diameter casing must be perfectly centered within the "A" section. However, the problem in most cases is that the casing is not centered in the "A" section, thus requiring centering by force. Typical methods, prior to the present invention, include the use of one of the drilling rig's winch lines. Such a method involves attempts to find a direct point for pulling in order to center the casing. The use of such a device and methods are not only time consuming, but can also be very dangerous.

While this basic illustration has been described in reference to an "A" section, the process may be repeated in the course of a well through "B", "C", "D", etc. sections.

For offshore operations, safety and time consumption can become even a greater concern. In such offshore operations—for example, in a jack up rig—the wellhead equipment lies below leverage points. Trying to find a point for pulling (in order to center the casing) becomes very difficult, if not impossible. Sometimes, the BOP is rocked against the casing in an attempt to jar the casing to the center point. This is not only extremely dangerous, but can also cause the support lines of the suspended BOP to break, dropping the BOP on personnel attempting to land the slips. On fixed platforms, where various production lines, other wellheads, etc. are in place, the temptation and sometimes practice is to use these as leverage points which can cause many potential dangers.

Another extremely important issue with regards to safety involves the time the blowout preventer (BOP) is uncoupled from the wellhead. The longer the duration of such uncoupling, the more likely that well control may be imperiled. Thus, the reduction of time in centering the casing becomes an issue.

The present invention in several embodiments increases the safety and reduces the centering task time. In essence, the centering tool assembly offers the following:

I. Safety and Reliability

II. Reduced Risk

III. Economics—Saved Rig and Operations Time

IV. Overall Comprehensive Safety

BRIEF SUMMARY OF THE INVENTION

In one embodiment of the invention, a centering tool assembly utilizes an actuator, baseplate, power source, support tube, and reaction studs to help centrally position a casing within an outer pipe. The baseplate is arranged and designed to couple to the outer pipe. The actuator is either pre-coupled to the baseplate or coupled to the baseplate after the baseplate couples to the outer pipe. The support tube is arranged and designed to vertically adjust and provide support for the actuator. The power source actuates the actuator, which provides a force on the casing, moving it into a desired position, typically a central position. The reaction studs help stabilize the centering tool assembly during the application of the actuation force.

Various other embodiments of the centering tool assembly are also disclosed. In some of the embodiments, the reaction studs are either not required at all or are replaced with other counteracting members. In yet another embodiment, the centering tool assembly may be used to pull the casing into the desired position.

Additionally, a method for positioning a casing into a desired position within an outer pipe involves coupling a baseplate to the outer pipe. An actuator is coupled to the baseplate, prior to or after said baseplate coupling. Then, the actuator may be vertically adjusted via a support tube. The actuator is activated via a power source and the casing is forced into the desired position.

BRIEF DESCRIPTION OF THE SEVERAL VIEWS OF THE DRAWINGS

For a further understanding of the nature, objects and advantages of the present invention, reference should be made to the following detailed description, read in conjunction with the following drawings, wherein like reference numerals indicate like elements and wherein.

FIG. 1 is a side elevational view of one embodiment of the centering tool assembly mounted on the flange of a wellhead;

FIG. 2 is a view taken along lines 2—2 of FIG. 1, showing a top view of the wellhead with the centering tool assembly attached to one portion of the wellhead flange;

FIGS. 7 and 8 show an embodiment where two centering tool assemblies are utilized;

FIGS. 9 and 10 shows two centering tools mounted on the same baseplate;

DETAILED DESCRIPTION OF THE INVENTION

In the central positioning of casing within an outer tubular assembly or other piece of pipe (such as a conductor pipe, a wellhead, another casing or the like), care must be taken so that the right magnitude of force is applied in the right direction. The principal is much like baseball's "home-run". If the bat makes contact with the ball at optimum points with the proper speed and direction, a home run is sure to follow.

Figure 4:
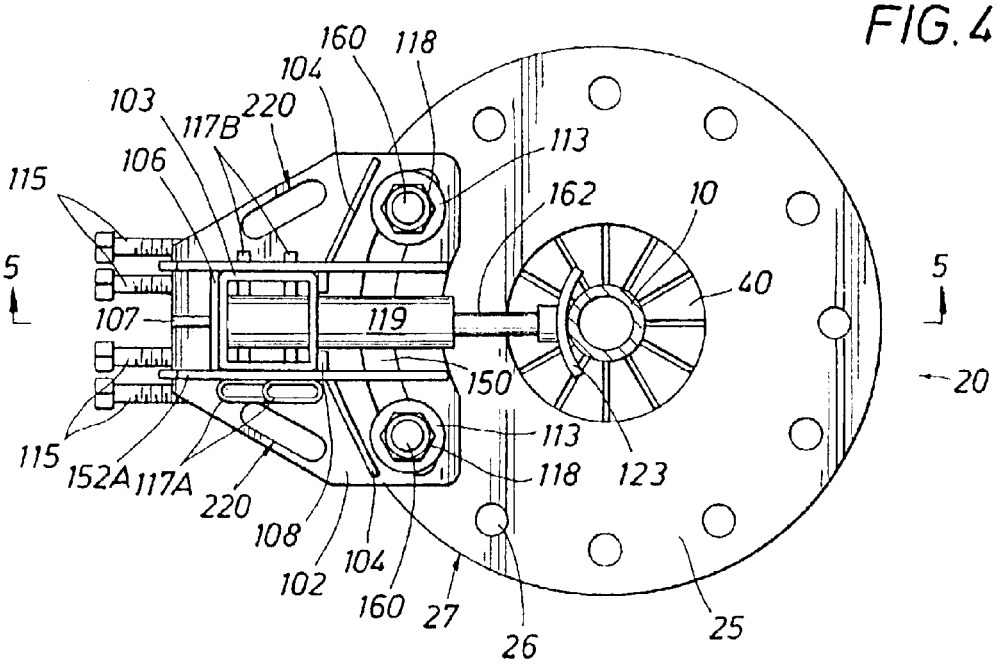
FIG. 4 is a view taken along lines 4—4 of FIG. 3, showing a top view of the actuator coming in contact with the casing.
Figure 3:
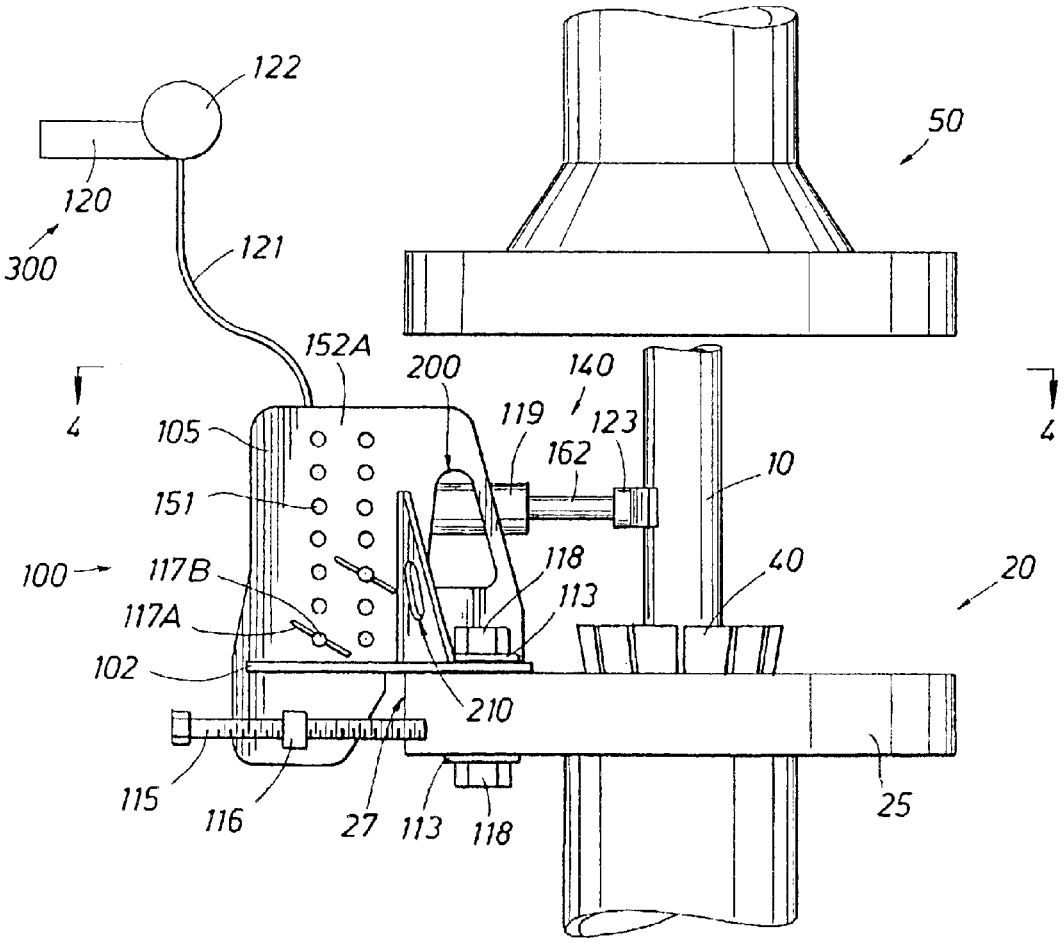
FIG. 3 shows a side elevational view of the embodiment of FIG. 1, with an actuator coming in contact with the casing.

When properly setup and aligned, the centering tool assembly 100 will make contact with the casing 10 and push the casing 10 in the correct direction and magnitude. As a result, the slips 40 will fall into place as shown in FIGS. 3 and 4. Hence, the centering tool assembly 100 can significantly reduce the time required and risk involved in this critical and most essential operation.

FIG. 1 is a side elevational view of one embodiment of the centering tool assembly 100 mounted on a flange 25 of a wellhead 20. Typically, the casing 10 is non-vertically located within the wellhead 20. As the casing 10 will extend through the center of a blowout preventer 50, the casing 10 needs to be adjusted. Thus, in the embodiment of FIG. 1, the blowout preventer 50 has been suspended above the wellhead 20 and the centering tool assembly 100 has been mounted on the flange 25 of the wellhead 20. In operation, an actuator 140 (which in this embodiment is a hydraulic cylinder 119) of the centering tool assembly 100 will push the casing 10 into a vertical, central position so that slips 40 (seen in FIG. 3) can be put in place, allowing the blowout preventer 50 to be lowered back into place on the wellhead 20. The details of the centering tool assembly 100 will be described below. It is also to be understood that the centering tool assembly 100 can also be used in other instances to force the casing 10 into desired positions other than in the center of the wellhead 20.

Referring to FIGS. 1–4, the centering tool assembly 100 as part of its framework includes a baseplate 102 with a transversely mounted frame 105 (FIG. 1). The baseplate 102 is arranged and designed to help establish the connection of the centering tool assembly 100 to the flange 25 of the wellhead 20. As can be seen in FIGS. 1 and 2, the baseplate 102 mates with the outer portion of the flange 25 via mounting studs 160, stud nuts 118 and washers 113. The mounting stud 160 passes through a mounting slot 150 (FIG. 2) in the baseplate 102 and a flange hole 26 (FIG. 2), and is bolted via the nuts 118 and washers 113. Such mounting operations should be apparent to one of ordinary skill in the art (for example, a nut and bolt).

In the embodiment of the centering tool assembly 100 shown in FIGS. 1–6, the frame 105 includes two parallel plates 152A, 152B (FIGS. 2, 4, and 6) with a plurality of pin holes 151 (FIGS. 1, 3, and 5) located on each respective plate. The parallel plates 152A, 152B are connected to the baseplate 102, preferably by welding. A support tube 103 and the cylinder 119 are housed between the parallel plates 152A, 152B—the details of which will be described with reference to FIG. 2 below. The plurality of pin holes 151 stabilize the support tube 103 via clips 117A and hitch pins 117B—the details of which will be described with reference to FIGS. 5 and 6.

Referring to FIGS. 1 and 2, protruding at an angle from parallel plates 152A, 152B are wing gussets 104, which connect with the baseplate 102. The wing gussets 104 are preferably connected to the parallel plates 152A and 152B and the baseplate 102 by welding. The wing gussets 104 serve as a structural support between the baseplate 102 and the frame 105, in addition to providing slots 210, which can be used to help adjust the centering tool assembly 100 into position for connection with the flange 25. In a similar manner, the parallel plates 152A, 152B have slots 200 and the baseplate 102 has slots 220 (seen in FIG. 2). These three sets of slots 200, 210, 220 allow for the positioning of the centering tool assembly 100, such that the cylinder 119 will be in proper alignment with the casing 10. The slots 200, 210, 220 also reduce the weight of the centering tool assembly 100 without adversely affecting its strength.

Facilitating the contact connection of the cylinder 119 with the casing 10 is a shoe 123 at the end of the cylinder 119. The shoe 123 will be described in greater detail below.

Figure 6:
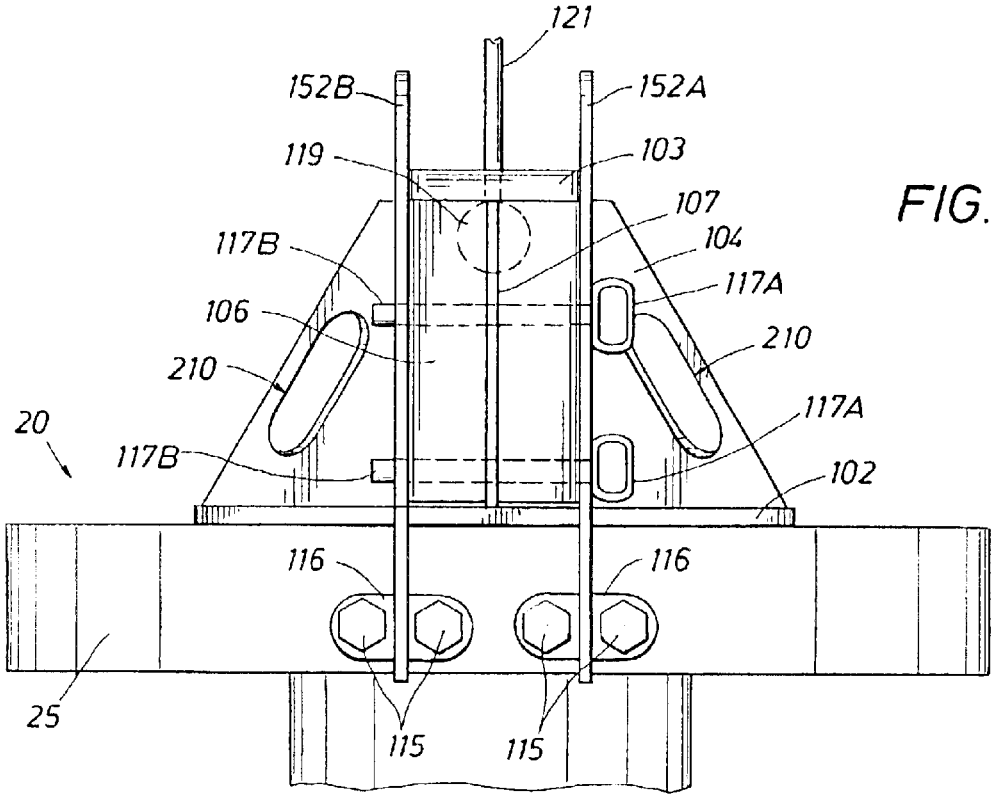
FIG. 6 is a rear view of the centering tool assembly looking towards the casing.

Referring to FIGS. 1 and 6, at a lower portion of the frame 105 are reaction stud nuts 116. As can be seen in FIG. 6, reaction stud nuts 116 are connected to the plates 152A, 152B, preferably by welding. Each reaction stud nut 116 is arranged and designed to support a reaction stud 115, allowing the reaction stud 115 to be forwardly advanced towards the flange 25 as shown in FIG. 1. The forward advancement of the reaction stud 115 continues until the reaction stud 115 mates with an outer diametric surface 27 of the flange 25. Preferably, the stud nuts 118 and mounting studs 160 and reaction studs 115 are initially loosely tightened until the centering tool assembly 100 is correctly aligned with the casing 10. Then, the stud nuts 118 and reaction studs 115 are firmly tightened. The reaction studs 115, in mating with the outer diametric surface 27 help stabilize the centering tool assembly 100 by countering the bending moments caused by the force of the actuated cylinder 119 against the casing 10. In other words, reactive forces from the cylinder 119 are transferred through the centering tool assembly 100 to the reaction studs 115 and back to the outer diametric surface 27 of the flange 25.

As shown in FIG. 1, The jacking force for the actuator 140 comes from a power source 300, which is arranged and designed to provide energy—be it electrical, hydraulic, or the like—to the actuator 140. In this embodiment, the actuator 140 is a cylinder 119, and the power source is a pump 120 that is fluidly coupled to the cylinder 119 via a hydraulic hose 121. The pump 120 can either be mechanically operated (e.g. a hand pump) or powered via electricity, diesel or an air pumping unit. Typical equipment, such as a pressure gauge 122, can be used to monitor how much pressure is being fed through the hydraulic hose 121 and to the cylinder 119. In an alternative arrangement, the actuator 140 can be power screws, gauging energy from the power source 300.

FIG. 2 shows a top view of the wellhead 20 with the centering tool assembly 100 attached to the wellhead flange 25. As mentioned above, the baseplate 102 includes a mounting slot 150 through which mounting studs 160 pass, helping mate the baseplate 102 to the flange 25 via the stud nuts 118 and washers 113. At least one (but preferably at least two) mounting studs 160 are passed through the mounting slot 150 and individual flange holes 26, helping to stabilize the centering tool assembly 100. The mounting slot 150 is preferably in the shape of an arc to allow adjustment of the mounting studs 160 for alignment with flange holes 26 in the mating of the baseplate 102 and flange 25. Such adjustability allows the centering tool assembly 100 to be placed on flanges 25 with different diameters. For example, any two flange holes 26 on an outer portion of the flange 25 are a certain linear distance apart. The mounting studs 160 can be slid in or out along mounting slot 150 to match that linear distance. Additionally, the arcuate mounting slot 150 preferably has a slightly oversized width to accommodate the hole pattern of flanges 25 of different diameters.

Figure 5:
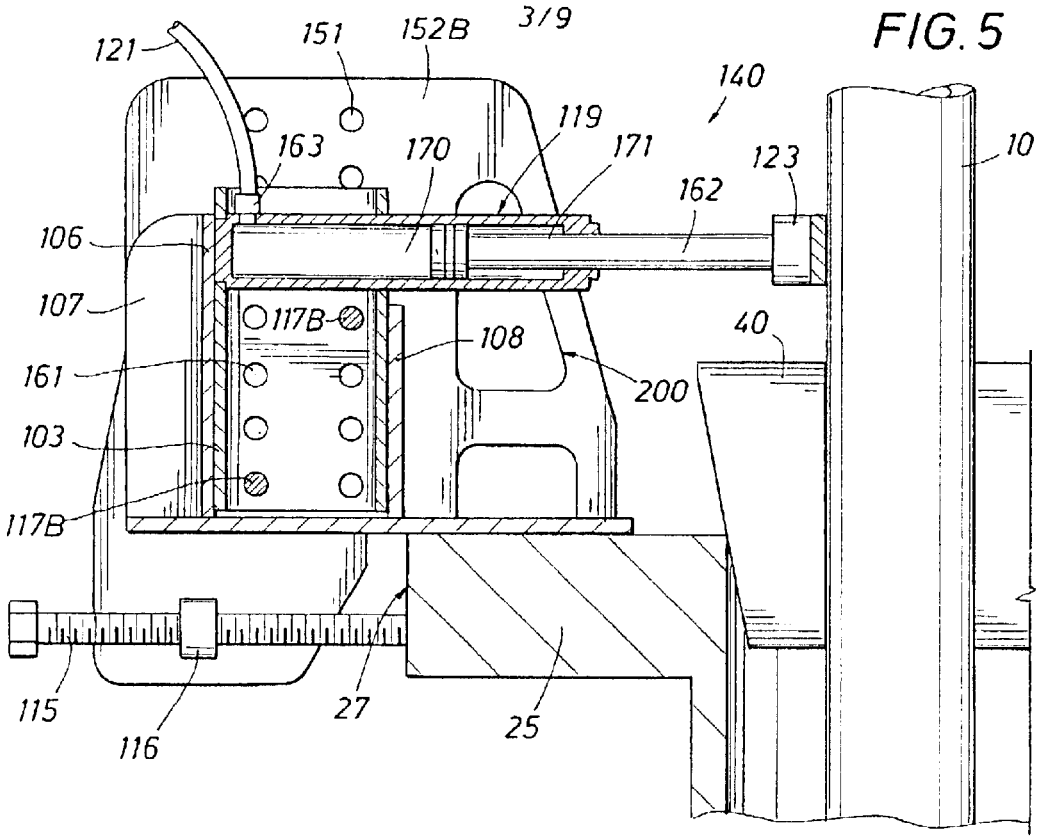
FIG. 5 is a view taken along lines 5—5 of FIG. 4, showing the actuator and support tube.

Referring to FIG. 2, the support tube 103 is shown between the parallel plates 152A, 152B, being stabilized in place via the hitch pins 117B and clips 117A. While only two hitch pins 117B are shown in the figures, it is to be understood that it may be desirable to use more depending on the size and load ratings. The support tube 103 is positioned between a rear plate 106 and front plates 108, both of which are rigidly attached, preferably by welding, to parallel plates 152A, 152B. Extending from the back of the rear plate 106 is a rear gusset 107 if desired for added strength and support. As shown in FIG. 5, the support tube 103 includes a plurality of aligned pin holes 161 extending through the support tube 103 and corresponding with the hole pattern in the parallel plates 152A and 152B. Each hitch pin 117B passes through one of the plurality of pin holes 151 in each parallel plate 152A, 152B and a pair of corresponding pin holes 161 in the support tube 103. More details will be explained with reference to FIGS. 5 and 6.

In the embodiment as shown in FIGS. 1–6, four reaction studs 115 are shown in FIGS. 2, 4, and 6 protruding from underneath the baseplate 102, one on each side of each of the parallel plates 152A, 152B of the frame 105. It is to be understood that fewer than four reaction studs 115 may be used. In some instances, one or two reaction studs 115 may be suitable. In yet other instances, no reaction studs may be necessary to counteract the bending moment forces created as the cylinder 119 centers the casing 10.

Figure 18:
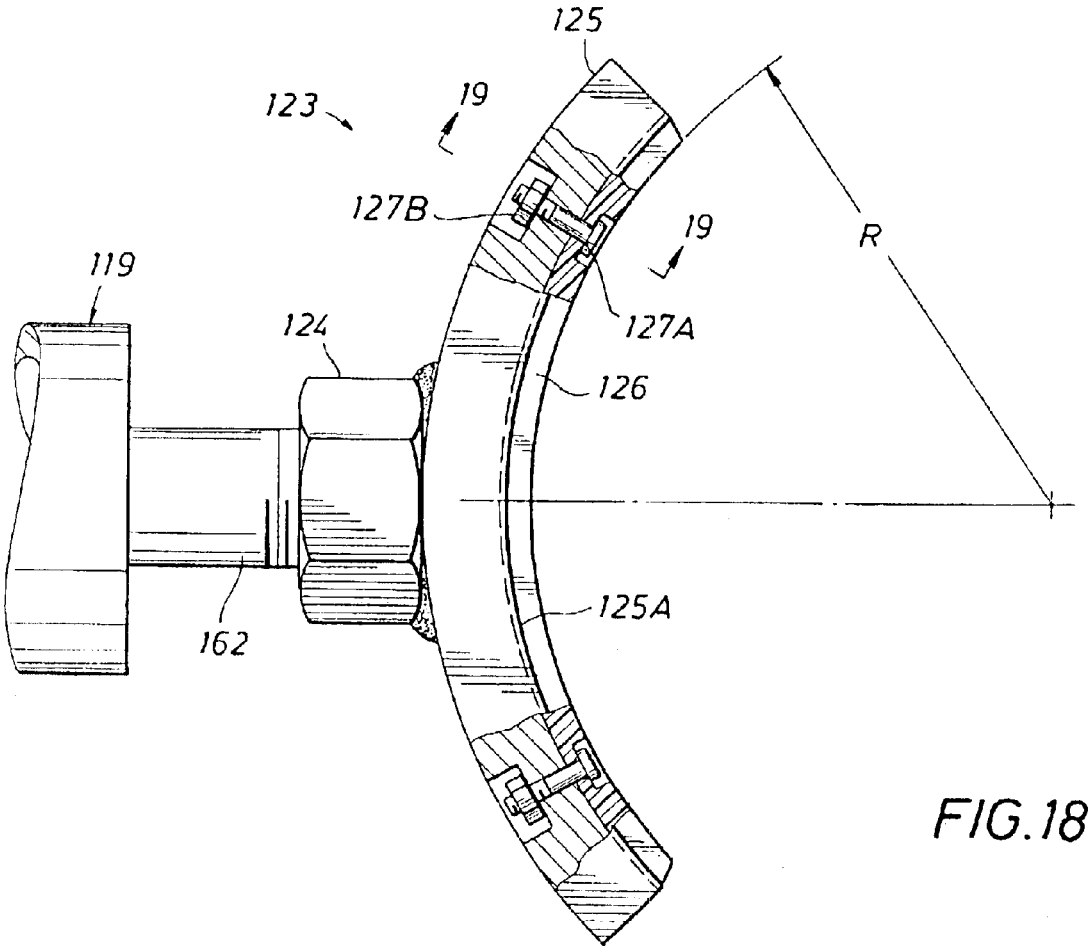
FIG. 18 is a top view of a shoe assembly.

Referring to FIGS. 1–5, the shoe 123 is shown at the end of the cylinder 119. The shoe 123 is arranged and designed to facilitate contact with the casing 10. In a preferred embodiment as shown in FIG. 18, the shoe 123 is also removably coupled to a cylinder rod 162 of the cylinder 119, such that several different shoes 123 can be coupled to the cylinder 119, each of the shoes 123 having a different radius of curvature R to correspond with a specific pipe or casing diameter. Alternatively, the radius of curvature R for each shoe 123 may be suitable for use over a certain range of pipe diameters. Preferably, the shoe 123 makes fairly uniform contact with the casing 10 along the inner radial surface of the shoe 123 to distribute the load being applied to the casing 10. Referring to FIG. 18, the removable shoe 123 is shown having an installation nut 124 adapted to be threaded onto the end of the rod of the cylinder 119. The installation nut 124 is secured to a shoe body 125. As discussed above, the shoe body 125 is preferably formed having a specific radius of curvature R to correspond with the a casing size typically used in these operations. Such removable coupling facilitates the desired contact with the outer surface of the casing 10 over a range of diameters.

Figure 19:
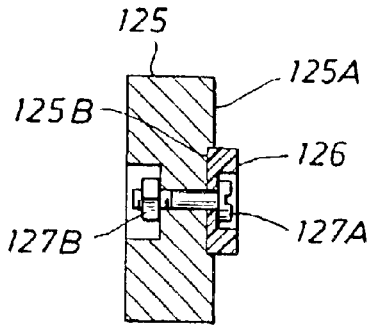
FIG. 19 is a view taken along lines 19—19 of FIG. 18.

In a preferred embodiment of the shoe 123 as shown in FIGS. 18 and 19, the shoe body 125 includes a recess 125B in the inner radial surface 125A. A wear band 126 is adapted to be received in the recess 125B and secured to the shoe body 125, as for example with a bolt 127A and nut 127B. The wear band 126 provides a smooth surface for contacting the casing 10, and reduces friction and the risk of damaging the outer surface of the casing 10.

FIG. 3 shows a side elevational view of the embodiment of FIG. 1, with the cylinder 119 coming in contact with the casing 10. The pump 120 has been activated in one of the manners described above, feeding pressure through the hydraulic hose 121 and actuating and extending the rod 162 of the cylinder 119. In operation, the actuation and extension of the rod 162 occurs until slight contact is made with the casing 10 via the shoe 123. Such slight contact allows assurance that the cylinder 119 and shoe 123 coupled thereto are in alignment with the casing 10. In situations where alignment has not occurred, the centering tool assembly 100 can simply be repositioned and moved. It is to be expressly understood that such an alignment operation can be used for both pushing and pulling operations. Pulling operations will be further explained below.

After alignment has occurred between the cylinder 119/shoe 123 and casing 10, the pump 120 is further activated, pushing (or pulling, in some embodiments described hereafter) the casing 10 into a vertical position. Typically, the vertical position is also centrally located within the outer tubular assembly 25. As mentioned above, the pressure from the pump 120 can be monitored via the pressure gauge 122 to assure that the correct amount of pressure is utilized—for example, a steady slow increase in pressure. Once the casing 10 has reached a vertical central position, the slips 40 can be installed as shown in FIGS. 3 and 4. The use of slips 40 being inserted around the casing 10 should become apparent to one or ordinary skill in the art. After the slips 40 have been installed, the pressure can be reduced, and the centering tool assembly 100 can be removed.

FIG. 5 is a cut away view of the cylinder 119 and support tube 103. The cylinder 119 is shown in an extended state as a result of pressure being applied from hydraulic hose 121 to a chamber 170, actuating the rod 162. The cylinder 119 can include a quick disconnect 163. Although not shown, it is to be understood that the rod 162 can be retracted by pressurizing the chamber 171 with a separate hydraulic hose. Alternatively, in certain embodiments of the present invention, pressurizing the chamber 171 can be used to pull the casing 10 into the desired position. It is to be understood that the cylinder 119 which has the capability of extending and retracting the rod 162 by pressurizing respective chambers 170 and 171 could be replaced with a ram having the capability of pressurizing only one chamber, such as the chamber 170, in order to push the casing 10 into the desired location.

In the embodiment of the present invention shown in FIGS. 1–6, the cylinder 119 is mounted upon an uppermost portion of the support tube 103. The support tube 103 is surrounded and supported by the rear plate 106, front plate 108, and parallel plates 152A, 152B. The support tube 103 can vertically telescope up and down within this support to provide height adjustment. And, if desired, the support tube 103 (with cylinder 119 attached) can be removed altogether from the centering tool assembly 100. The telescoping ability of the support tube 103 allows a height adjustment at which the cylinder 119 will apply force on the casing 10, avoiding contact with the slips 40. When a desired telescoped position has been reached, the support tube 103 is stabilized in place via the insertion of preferably at least two hitch pins 117B, as described above. The clips 117A are used at the end of each of the respective hitch pins 117B to prevent inadvertent retraction of the hitch pins 117B.

FIG. 6 is a rear view of the centering tool assembly 100 looking towards the casing 10. The stud nuts 116 are shown on each side of the parallel plates 152A, 152B. The reaction studs 115 extend through the stud nuts 116, coming in contact with the diametric surface 27 of flange 25 as shown in FIG. 5.

Referring to FIG. 6, the rear plate 106 is shown extending between the parallel plates 152A, 152B. Extending down the face of the rear plate 106 is the rear gusset 107. Extending beyond the top of the rear plate 106 is the support tube 103. The hitch pins 117B are shown installed through the parallel plates 152A, 152B and support tube 103 with the clips 117A on the outside edge of parallel plate 152A. Located just above the hitch pins 117B is the cylinder 119 with hydraulic hose 121 extending from the top thereof. The baseplate 102 is shown mated against the flange 25 and the wing gussets 104 (including the slots 210) are shown extending out from the parallel plates 152A, 152B.

As briefly mentioned above, the cylinder 119 of the centering tool assembly 100 helps adjust the casing 10 so that slips 40 can be inserted. With reference to FIGS. 1 through 6, in operation, the centering tool assembly 100 can be moved and handled via use of the slots 200, 210, and 220. In some embodiments of the invention, the centering tool assembly 100 may be light enough to be installed by a single individual. In other embodiments of the invention, the centering tool assembly 100 may require two or more individuals or a hoist, which via the use of a chain, sling, or the like can be looped through the slots 200 or, depending on the structural integrity of the centering tool assembly 100, looped through slots 210 or slots 220. In an alternative arrangement, the cylinder 119 and support tube 103 can be moved separately from the rest of the structure of the centering tool assembly 100, reducing the weight of the remaining structure of the centering tool assembly 100. In other words, the centering tool assembly 100, absent the support tube 103 and cylinder 119, can optionally be initially placed on the upper face of the flange 25. Then, the support tube 103 and the cylinder 119 can be placed into position. If the entire centering tool assembly 100 is moved together, preferably the hitch pins 117B and clips 117A are in place.

Once the entire centering tool assembly 100 has been placed on the upper face of the flange 25, preferably at least two mounting studs 160 are passed through the flange holes 26 and the mounting slot 150. As mentioned above, the mounting studs 160 can be adjusted at different locations throughout the mounting slot 150—that is, they can be moved in or out—to adjust for the location of the flange holes 26. Once the mounting studs 160 are in place, the washers 113 are placed on the mounting studs 160 and the studs nuts 118 are loosely tightened—enabling the ability to loosen the stud nuts 118 if the centering tool assembly 100 should need to be relocated.

After loosely tightening the stud nuts 118, the support tube 103 is telescoped to the desired height for the contact of the cylinder 119 and shoe 123 against the casing 10. Preferably, as mentioned above, the height chosen is such that the cylinder 119 will not interfere with the slips 40. After establishing the desired height for the support tube 103, preferably at least two hitch pins 117B are each respectively inserted through one of the plurality of pins holes 151 in each parallel plate 152A, 152B and a pair of pin holes 161 in the support tube 103. The clips 117A can then be coupled to the end of hitch pins 117B, preventing retraction of the hitch pins 117B. At least one, but preferably at least two reaction studs 115 inserted through the stud nuts 116 are threaded into slight contact with the annular surface 27 of the flange 25—allowing easy removal if adjustment needs to be made to the centering tool assembly 100.

Upon the loose tightening of the stud nuts 118 and reaction studs 115, the desired shoe 123 is removably coupled to the end of the rod 162 of the cylinder 119. As mentioned above, the choice of shoe 123 can depend on the diameter of the casing. After installation of the shoe 123, the cylinder rod 162 is extended towards the casing 10, bringing the shoe 123 into slight contact with the casing 10. In embodiments where the cylinder 119 is pushing, this may be accomplished via simply putting slight pressure in the chamber 170. If misalignment has occurred, the centering tool assembly 100 can preferably be slid along the mounting slot 150, or unbolted and moved. Once alignment occurs, the reaction studs 115 and stud nuts 118 are tightened. As previously discussed, depending on the loads to be applied and the design of the framework, reaction studs 115 may not be needed.

Once the tightening of the reaction studs 115 and stud nuts 118 has occurred, the pump 120 is activated and the cylinder 119 is actuated via the fluid traveling through the hydraulic hose 121. As described above, the pushing of the casing 10 is accomplished via the pressurization of chamber 170. The pressure is monitored via pressure gauge 122 to allow for a controlled force. In an alternative arrangement, the actuator 140 can be a power screw.

Once the casing 10 has been vertically aligned, slips 40 are allowed to fall in place. After the slips 40 are in place the pressure from the pump 120 can be released and the centering tool assembly 100 removed.

FIGS. 7 and 8 show an embodiment where two centering tool assemblies 100 are utilized to center the casing 10. The centering tool assemblies 100 are similar to centering tool assemblies of the other embodiments, yet work in conjunction with one another to facilitate the positioning of the casing 10 by providing forces at different angles. The centering tool assemblies 100 can be placed anywhere around the wellhead flange 25, depending on the location of the casing 10 and the manner in which forces are needed for centering the casing 10. In still other embodiments, more than two centering tool assemblies 100 can be utilized.

FIGS. 9 and 10 show an embodiment 100' where two centering tools 100 are mounted upon a single baseplate 102'. These two centering tools 100 operate in a manner similar to that of FIGS. 7 and 8, yet maintain structural integrity between the centering tools 100 via the single baseplate 102'. Additionally, only two or three mounting studs 160 may be required through the single mounting slot 150'. Additionally, the reaction studs may or may not be required in the embodiments of FIGS. 7–10.

Figure 11:
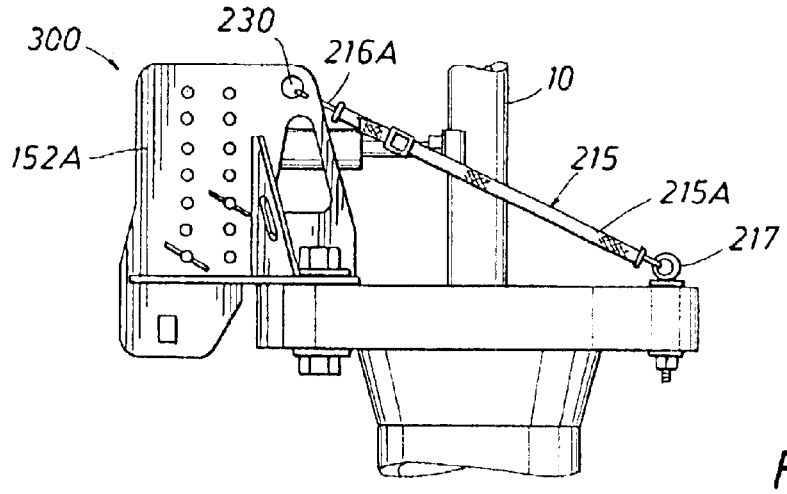
FIGS. 11–13 are side elevational views of additional embodiments of the centering tool assembly of the present invention.
Figure 12:
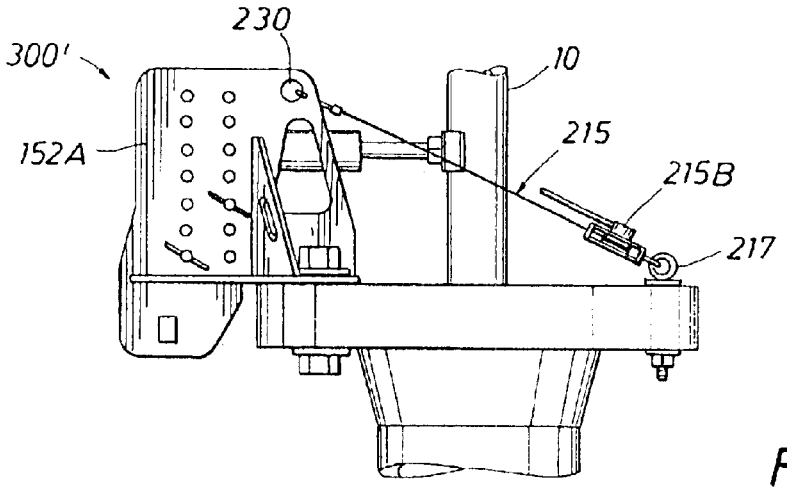
Figure 13:
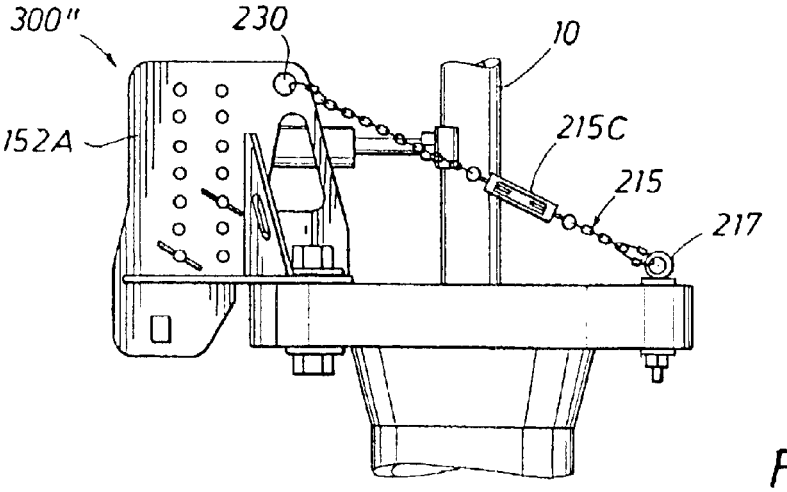

FIGS. 11–13 show additional embodiments 300, 300' and 300", similar to the embodiment 100 of FIGS. 1–6. In the embodiments of FIGS. 11–13 the reaction studs have been replaced with one or two counteracting members or assemblies 215 which provide support in tension. In the embodiments of FIGS. 11–13, an opening 230 has preferably been made in the upper portion of each of the parallel plates 152A and 152B. In FIG. 11, the counteracting assembly 215 is a strap assembly 215A, as for example a ratchet tie down. One such ratchet tie down is commercially available from Keeper Corp. The strap assembly 215A preferably has an attachment member or hook 216A on each end. One hook 216A is attached to the plate opening 230 and the other hook 216A is attached to an eyebolt 217 secured to the flange 25. As shown in FIG. 11, the strap assembly 215A preferably includes means for manually pretensioning the strap, such as a buckle to adjust the strap length, prior to applying the load to the casing 10. Preferably, a pair of counteracting assemblies 215 are used to evenly distribute the force.

Referring to FIG. 12, the counteracting assembly 215 of the centering tool assembly 300' includes one or two come-a-long pullers 215B, preferably cable or chain style. These devices are sometimes referred to as cable pullers. Once again, in use the come-a-long puller 215B is preferably pretensioned prior to applying the load to the casing.

Referring to FIG. 13, the counteracting assembly 215 of the centering tool assembly 300" includes one or two cable or chain and turnbuckle assemblies 215C. In each of the embodiments of FIGS. 11–13, the counteracting assembly 215 preferably includes a means for pretensioning the assembly 215 prior to counteracting the load imposed upon the casing 10 by the actuator 140. The counteracting assembly 215 of FIGS. 11–13 are placed in tension as the casing 10 is pushed into the desired location.

It is to be understood that the centering tool assemblies 300, 300', and 300" of FIGS. 11–13 incorporate cross bracing or across the flange bracing wherein the counteracting assembly 215 is in tension. The counteracting assembly 215 can be any device that is adjustable in length and can resist the loads induced by the reaction of the centering tool assembly to the casing 10.

The installation and use of the centering tool assembly 300, 300', or 300" is very similar to the centering tool assembly 100 described above. The centering tool assembly 300, 300', or 300" is attached to the flange 25 and the appropriate size shoe 123 is installed to match the outside diameter of the casing 10. The counteracting assemblies 215 are installed as described above and the shoe 123 is brought into contact with the casing 10 to exert a slight force against the casing 10. This allows the baseplate 102 to bear against the mounting studs 160. Once aligned and in place, the counteracting assemblies 215 can be tightened to secure the centering tool assembly 300, 300', or 300". The casing 10 is now ready to be moved into position.

It is to be understood that when the forces required to move the casing 10 into position are very low, the procedure may be accomplished without the assistance of the reaction studs 115 (FIGS. 1–10) or the counteracting assembly 215 (FIGS. 11–13). As the required forces increase, the need for either the reaction studs 115 or the counteracting assembly 215 becomes more important. Preferably, the reaction studs 115 are used for moderate to light-heavy loads while the cross bracing is used for heavy loads or if the tool is used in the extended height position with moderate loads.

Figure 15:
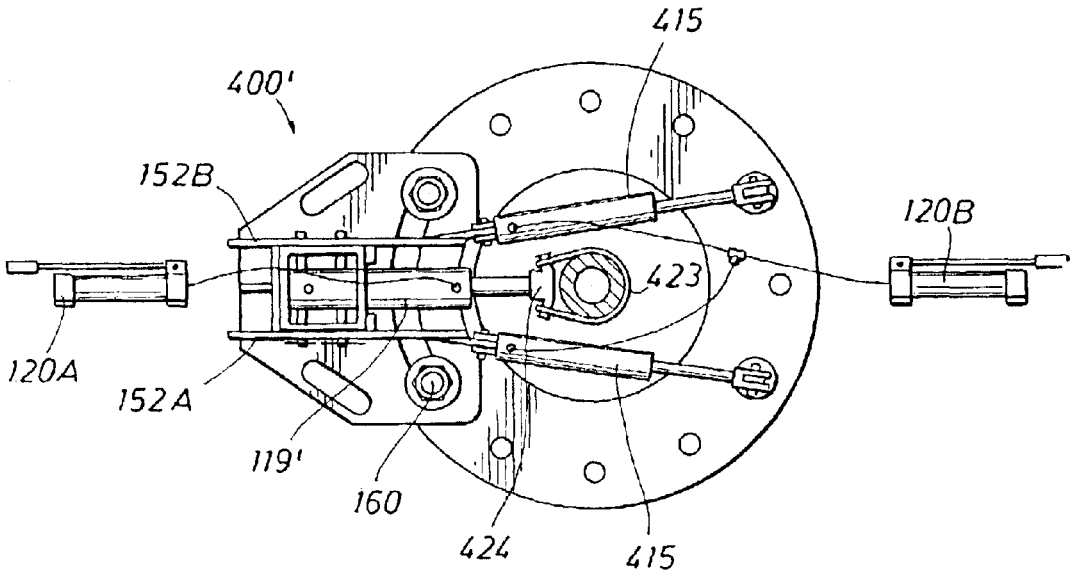
FIG. 15 is a view taken along lines 15—15 of FIG. 14, showing a top view of the wellhead with the centering tool assembly attached to one portion of the wellhead flange.
Figure 14:
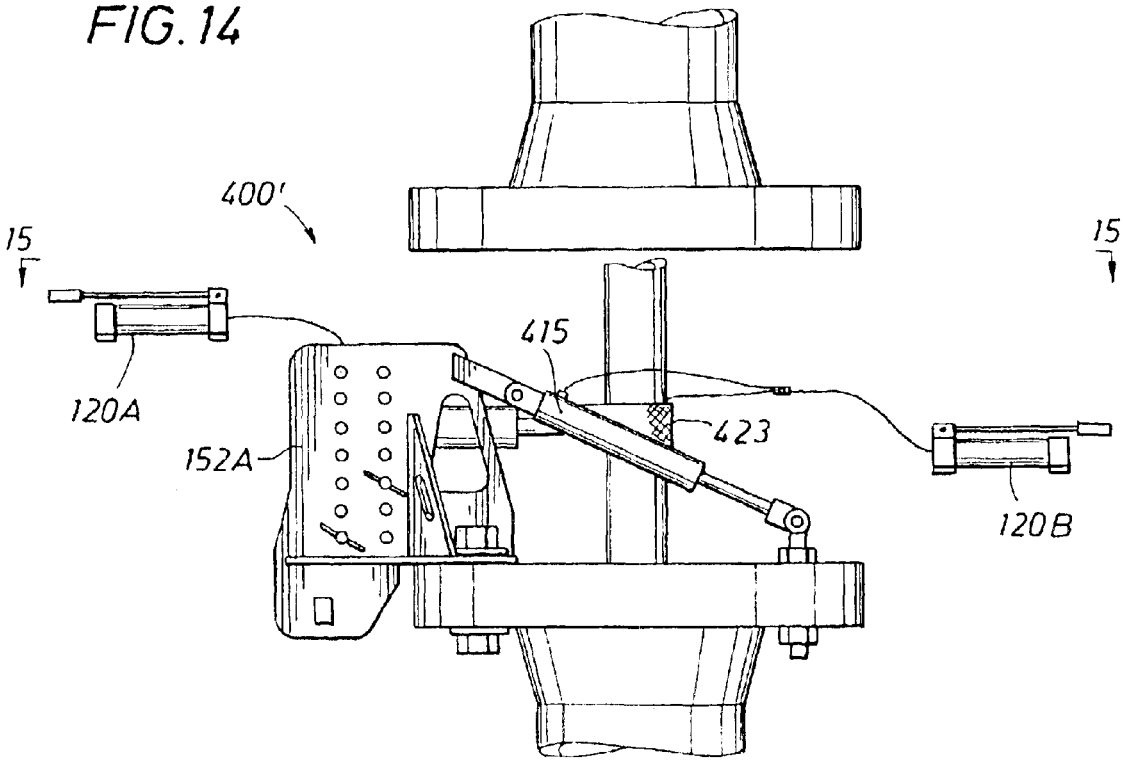
FIG. 14 is a side elevational view of yet another embodiment of the centering tool assembly of the present invention mounted on the flange of a wellhead.
Figure 16:
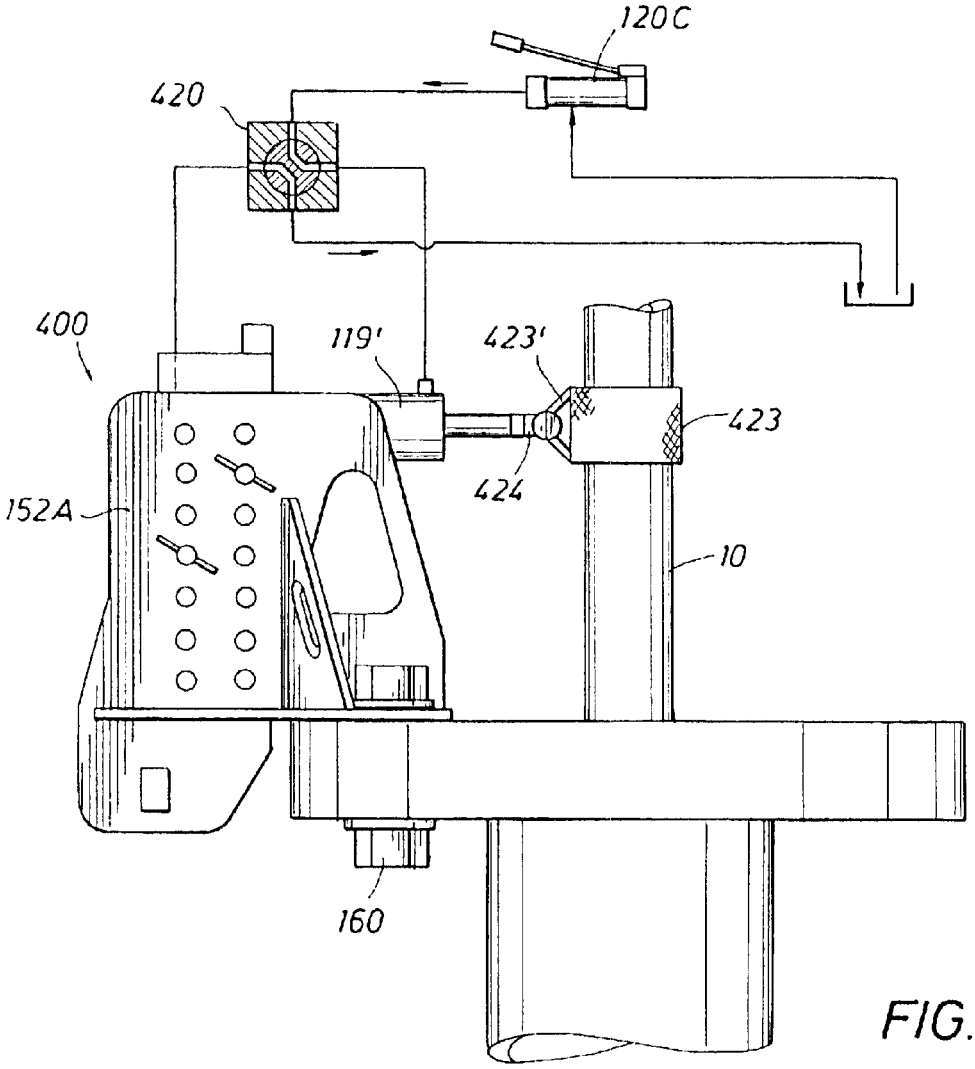
FIG. 16 is a side elevational view of yet another embodiment of the centering tool assembly of the present invention mounted on the flange of a wellhead.
Figure 17:
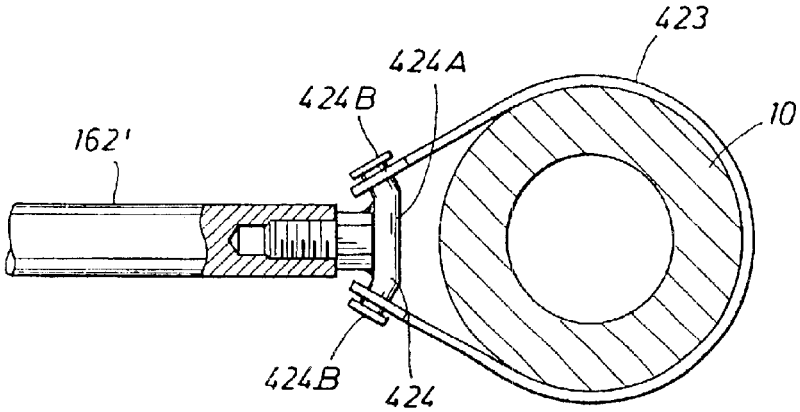
FIG. 17 is a partial sectional view of the actuator and sling assembly.

As shown in FIGS. 14–17, the present invention can also be adapted to pull the casing 10 into position as opposed to pushing the casing 10. The centering tool assembly 400 of FIG. 16 and centering tool assembly 400' of FIGS. 14–15 are very similar to the prior embodiments. The centering tool assembly 400 preferably includes a spring loaded "pull" cylinder or a double acting cylinder 119'. Alternatively, it is to be understood that a power screw could be used in place of the cylinder. A pulling adapter 424 is adapted to attach to the cylinder rod 162', preferably by threading, as shown in FIG. 17. The pulling adapter 424 includes a cross member 424A having a head 424B on each end of the cross member 424A. A sling assembly 423 has a loop or eye 423A at each end of the sling assembly 423. The sling loop 423A is adapted to fit over the head 424B and onto the cross member 424A as shown in FIG. 17. The sling assembly 423 is adapted to wrap substantially around the casing 10 and can be made out of various materials including, but not limited to, polyester or other synthetic webbing of suitable strength.

The tensioned counteracting member 215 of the "pushing" embodiments 300, 300' and 300" of FIGS. 11–13 is replaced in the "pulling" embodiment 400' of FIGS. 14 and 15 with one or two adjustable compression members 415. The adjustable compression members 415 may be single or double acting cylinders. As shown in FIG. 14, the cylinder 415 is attached at one end to an eyebolt 217 and at a second end to the upper portion of the parallel plate 152A or 152B (FIG. 15). The cylinders 119' and 415 may be controlled by various techniques as are well known in the art. As shown in FIGS. 14 and 15, the cylinder 119' may be controlled with a first hand pump 120A and the cylinders 415 controlled with a second hand pump 120B.

Referring to FIG. 16, the centering tool assembly 400 does not include any adjustable compression members. A hand pump 120C is shown used with a three or four way control valve 420 connected to the double acting cylinder 119'. If needed or desired, adjustable compression members 415 as shown in FIGS. 14–15 could be used with this centering tool assembly 400.

The installation and use of the centering tool assembly 400 and 400' is similar to the procedures described above. The centering tool assembly 400, 400' is attached to the flange 25 and the appropriate size sling 423 is extended substantially around the outside diameter of the casing 10 and each sling loop 423A is fitted onto the cross member 424A of the pulling adapter 424. The actuator 140 is retracted to set a preload on the casing 10 and to firmly set the baseplate against the mounting studs 160. In the embodiment of FIG. 16, the mounting studs 160 are tightened with the centering tool assembly 400 in proper alignment and the casing 10 is now ready to be pulled into the desired position. In the embodiment of FIGS. 14–15, the compression members 415 are installed as described above and the compression members 415 are extended until a firm, rigid mounting is achieved. The casing 10 is now ready to be pulled into position.

It is to be expressly understood that the invention is not limited to the exact details, embodiments, or features describe herein as obvious modifications will become apparent to one of ordinary skill in the art. For example, while the centering tool assembly has generally been illustrated with the use of centering casing 10 between a wellhead 20 and blowout preventer 50, the centering tool assembly can also be used for centering or positioning casing or members at other locations. Furthermore, while the term "vertical" has been used with reference to the embodiment described herein, such should not be interpreted as being a requirement for every embodiment. For some embodiments, the central location for the casing 10 or the desired position, may not be vertical. Therefore, the invention is only limited by the scope of the claims.

We claim:

1. A tool assembly for positioning an inner tubular member in a desired position within an outer tubular assembly, comprising:

a baseplate adapted to be secured to the outer tubular assembly;

an actuator connected to said baseplate; and a power source connected to said actuator and providing energy for said actuator, wherein said actuator is positioned to exert a force against the inner tubular member to move the inner tubular member into the desired position.

2. The tool assembly of claim 1, further comprising a support shoe attached to said actuator, said support shoe adapted to contact the inner tubular member.

3. The tool assembly of claim 1, further comprising a support tube coupled to said baseplate, wherein said support tube supports said actuator.

4. The tool assembly of claim 3, wherein said support tube is capable of vertical adjustment.

5. The tool assembly of claim 1, further comprising at least one reaction stud coupled to said baseplate to help stabilize said actuator, wherein said reaction stud is adapted to contact the outer tubular assembly.

6. The tool assembly of claim 5, further comprising a frame secured to said baseplate, wherein said support tube couples to said baseplate via said frame and said reaction stud couples to said baseplate via said frame.

7. The tool assembly of claim 6, wherein said actuator is a hydraulic cylinder.

8. The tool assembly of claim 6, wherein said actuator is a powerscrew.

9. The tool assembly of claim 5, further comprising a support tube coupled to said baseplate, wherein said support tube supports said actuator.

10. The tool assembly of claim 1, further comprising a frame secured to said baseplate, wherein said actuator couples to said frame.

11. A centering tool assembly for positioning an inner tubular member within an outer tubular assembly, comprising:

a baseplate adapted to be secured to the outer tubular assembly;

a frame connected to said baseplate;

an actuator coupled to said frame;

a power source connected to said actuator, said power source providing energy for said actuator, said actuator being positioned to exert a force to the inner tubular member to move the inner tubular member into a central position; and a counteracting member adapted to resist loads induced by the reaction of said actuator with the inner tubular member.

12. The centering tool assembly of claim 11, further comprising a support tube coupled to said frame, said support tube supporting said actuator and allowing vertical adjustment of said actuator.

13. The centering tool assembly of claim 11, wherein said actuator is a powerscrew.

14. The centering tool assembly of claim 11, wherein said actuator is a cylinder and said power source is a pump, said pump being coupled to said cylinder via a hydraulic hose.

15. The centering tool assembly of claim 14, further comprising a contact support coupled to an end of said cylinder.

16. The centering tool assembly of claim 15, wherein said contact support is a shoe.

17. The centering tool assembly of claim 16, wherein said shoe has an inner radius adapted to correspond with the radius of the inner tubular member.

18. The centering tool assembly of claim 17, further comprising a wear band secured to said inner radius of said shoe, said wear band adapted to come into contact with the inner tubular member.

19. The centering tool assembly of claim 15, wherein said contact support is a sling assembly.

20. The centering tool assembly of claim 11, further comprising:

a slot through said baseplate; and a stud capable of extending through said slot and securing said baseplate to the outer tubular assembly, said slot being arranged to allow orientation of said actuator with respect to the inner tubular member.

21. The centering tool assembly of claim 11, wherein said counteracting member is at least one reaction stud coupled to said frame, said reaction stud is adapted to contact the outer tubular assembly and provide stability.

22. The centering tool assembly of claim 11, wherein said counteracting member is a reaction stud coupled to said baseplate and adapted to contact the outer diameter surface of the outer tubular assembly.

23. The centering tool assembly of claim 11, wherein said counteracting member is a tension member coupled to said frame and the outer tubular assembly.

24. The centering tool assembly of claim 11, wherein said counteracting member is a tie down coupled to said frame and the outer tubular assembly.

25. The centering tool assembly of claim 11, wherein said counteracting member is a cable or chain type apparatus adapted to be coupled to said frame and the outer tubular assembly.

26. A method for positioning an inner tubular member in a desired position within an outer tubular assembly by use of a positioning tool assembly, the method comprising the steps of:

mounting the tool assembly to the outer tubular assembly;

actuating a tool actuator to bring a contact support into firm contact with the inner tubular member;

firmly secure the tool assembly to the outer tubular assembly; and position the inner tubular member by further actuation of the actuator.

27. The method of claim 26, further comprising the step of adjusting the vertical height of the tool actuator prior to said step of actuating the tool actuator.

28. The method of claim 26, further comprising the step of stabilizing the tool assembly via at least one reaction stud.

29. The method of claim 26, further comprising the step of stabilizing the tool assembly via a counteracting member.

30. The method of claim 26, wherein the actuator is a ram powered by a pump.

31. The method of claim 26, wherein the actuator is a powerscrew.

32. The method of claim 26, wherein the contact support is a contoured shoe adapted to engage the outer surface of the inner tubular member.

33. The method of claim 32, wherein the contoured shoe includes a wear band having a low frictional surface.

* * * * *